US005568922A

United States Patent [19]

Siddle

[11] Patent Number: 5,568,922

[45] Date of Patent: Oct. 29, 1996

[54] COMPOSITE TELESCOPING BATON

[75] Inventor: Bruce K. Siddle, Waterloo, Ill.

[73] Assignee: PPCT Management Systems, Inc., Millstadt, Ill.

[21] Appl. No.: 249,279

[22] Filed: May 25, 1994

Related U.S. Application Data

[63] Continuation-in-part of Ser. No. 141,068, Oct. 26, 1993, Pat. No. 5,372,363.

[51] Int. Cl.[6] ..... F41B 15/02

[52] U.S. Cl. ..... 273/84 R; 473/319

[58] Field of Search ..... 273/84 R, 84 ES, 273/80 D, 32 F, 68, 69; 135/75; 16/115; 343/901; 473/319

[56] References Cited

U.S. PATENT DOCUMENTS

| | | | |
|---|---|---|---|
| 4,157,181 | 6/1979 | Cecka | 273/80 R |
| 4,456,255 | 6/1984 | Braunhut . | |
| 4,964,636 | 10/1990 | Ashihara . | |
| 5,093,162 | 3/1992 | Fenton et al. | 273/80 B |
| 5,110,375 | 5/1992 | Parsons | 273/84 R |
| 5,160,140 | 11/1992 | Starrett . | |
| 5,161,800 | 11/1992 | Parsons et al. . | |

FOREIGN PATENT DOCUMENTS

| | | |
|---|---|---|
| 543517 | 7/1957 | Canada . |

*Primary Examiner*—William M. Pierce
*Attorney, Agent, or Firm*—Paul M. Denk

[57] ABSTRACT

A telescoping baton having a handle section, a middle section which collapses into the handle section or extends out of the handle section, and an end section which can collapse into the middle section or extend down the middle section. The handle and middle sections are formed from a composite material of continuous filament wound fibers, both glass and Kevlar® in a matrix of epoxy resin. The end section is formed from a continuous filament wound fiber, both glass and kevlar, around a steel core. Tapered bores within the handle and middle sections engaged raised collars machined onto the middle and end sections respectively to lock the device in an extended position. A wire clip in the end cap of the handle section engages a bore in the end section when the device is collapsed to releasably hold the baton and the collapsed state.

5 Claims, 4 Drawing Sheets

D10
D7
D5
D8
D6
D9
9B
10B
100
102
104
106
108
109
85
86
88
89
82
S2
84
90
R
H
60
62
63
114
115

COMPOSITE TELESCOPING BATON

This application is a continuation-in-part of application Ser. No. 08/141,068, filed Oct. 26, 1993, now U.S. Pat. No. 5,372,363.

BACKGROUND OF THE INVENTION

This invention relates generally to batons, more particularly to a light-weight telescoping baton, and method of making the same, constructed from composite material for use by policeman in the field or during training exercises.

Expandable or telescoping batons are often carried by law enforcement officers or security personnel instead of the traditional, one-piece night stick. Typically, the traditional night stick is made of wood and is approximately 26 inches long and 1¼ inches in diameter. Long, one-piece night sticks are inconvenient to carry for obvious reasons.

Expandable batons have increased in popularity because, in the collapsed state, the overally length of the baton can be as short as eight or nine inches. Generally, expandable batons are constructed in sections which telescope. A tubular main section functions as a handle; progressively smaller, tubular sections fit within each other and can be collapsed into one another or expanded outward. When completely collapsed, the sections all fit within the handle section. When expanded, the sections are locked together, end-to-end, by friction fittings such as taper joints. When expanded, the overall length of the baton can be 18 to 20 inches.

Prior art expandable or telescoping batons are constructed from metal such as soft steel. Batons made from hard steel provide better service but are expensive to manufacture, as are batons constructed from alloy steel. Metal batons have notable drawbacks. The metal is prone to metal fatigue and can crack or rust. Furthermore, metal batons bear a close similarity to a piece of metal pipe, which is aesthetically unpleasing.

The unique composite expandable baton disclosed in my co-pending patent application Ser. No. 08/141,068, filed Oct. 26, 1993, now U.S. Pat. No. 5,372,363, alleviates many of the problems associated with prior art metal batons. However, injection molded composite telescoping batons can also suffer from joint fatigue and separation. I have determined that filament winding prohibits separation and structurally strengthens the joint. I have determined that baton components formed of a composite material by the continuous winding of glass and Kevlar® filaments in epoxy allows for the optimal winding of the filaments at the joint area so as to provide a structurally strengthened joint that resists joint fatigue and separation.

Furthermore, although a composite baton manufactured from injection molding has weight-to-strength characteristics superior to metal batons, I have determined that a baton constructed from a filament winding procedure creates a baton, that is virtually unbreakable in field use situations. Moreover, the walls of batons sections formed from a filament wound winding procedure can be thin resilient thereby decreasing the weight of the baton. Various filament winding angles applied in appropriate layers create a desired strength-to-weight ratio unachievable by using metal or injection molding composite materials.

SUMMARY OF THE INVENTION

It is, therefore, a principal object of the present invention to provide a telescoping baton made of composite material comprised of continuous filament wound fibers.

Yet another object of the invention is to provide a telescoping baton formed of continuous wound fiber of glass and Kevlar® in a matrix of epoxy material.

Still another object of the present invention is to provide a telescoping baton wherein the continuous wound fibers of glass and Kevlar® are wound in an appropriate configuration at the joint areas so as to increase structural strength of the joint areas.

Still another-object of the present invention is to provide a telescoping baton that has an optimum strength-to-weight ratio is easy and economical to manufacture and well suite for it intended purposes.

In accordance with the invention, generally stated, a telescoping baton is provided having a handle section, a middle section which fits within the handle section, and an end section which fits within the middle section. The middle and end sections can be extended out of or collapsed into the handle section. The handle and middle section are formed from a composite of continuous material filament wound fibers, both glass and Kevlar® in a matrix of epoxy resin. The end section is constructed of continuous filament wound fibers, both glass and Kevlar®, in epoxy wound about a metal core. The continuous wound fibers are wound at the optimum configuration at the joint areas so as to provide locking joints of optimum structural strength. A wire clip, located in the end cap on the handle section, engages a bore in the end section when the baton is collapsed thereby releasably holding the baton in a collapsed state.

DESCRIPTION OF THE PREFERRED EMBODIMENT

Figure 1:
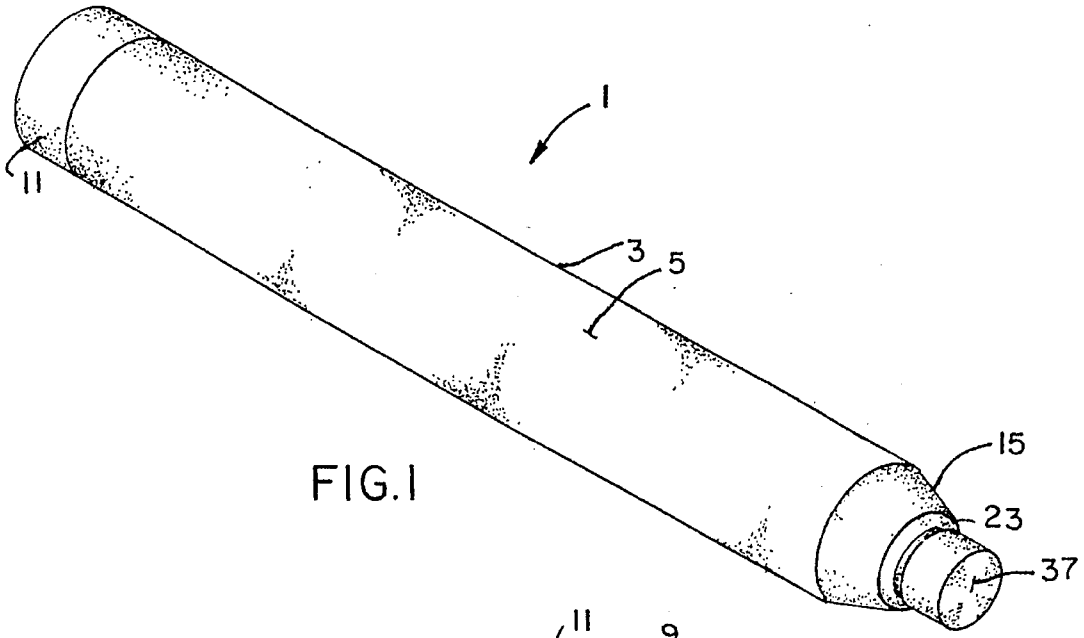
FIG. 1 is perspective view of the telescoping baton of the present invention in the collapsed state.
Figure 2:
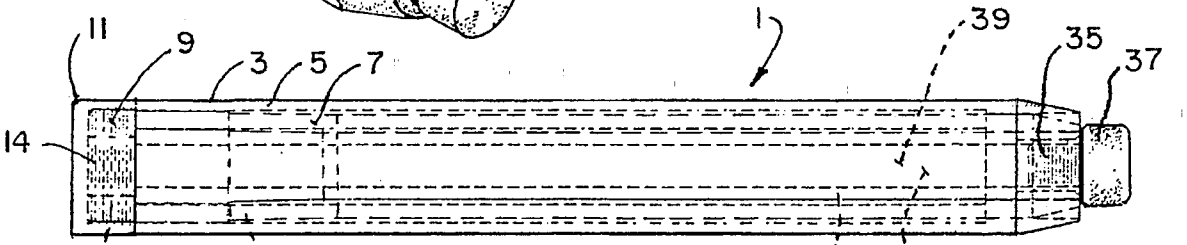
FIG. 2 is a side elevational view of the telescoping baton of the present invention in a collapsed state, showing the arrangement of the internal elements in phantom.
Figure 3:
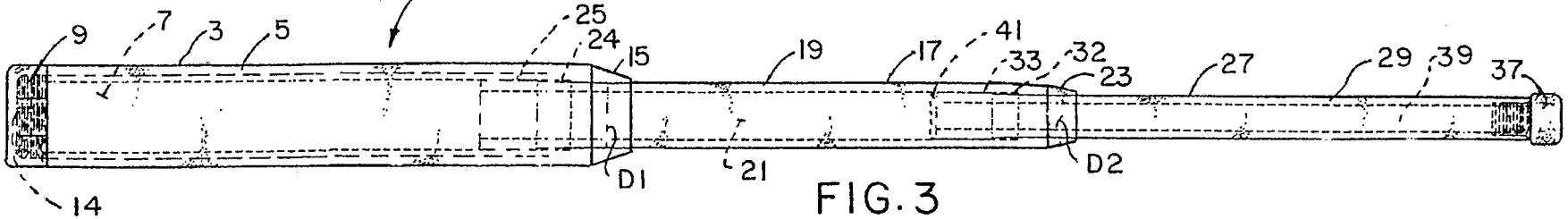
FIG. 3 is a side elevational view of the telescoping baton of the present invention in an extended state, showing the arrangement of the internal elements in phantom.
Figure 4:
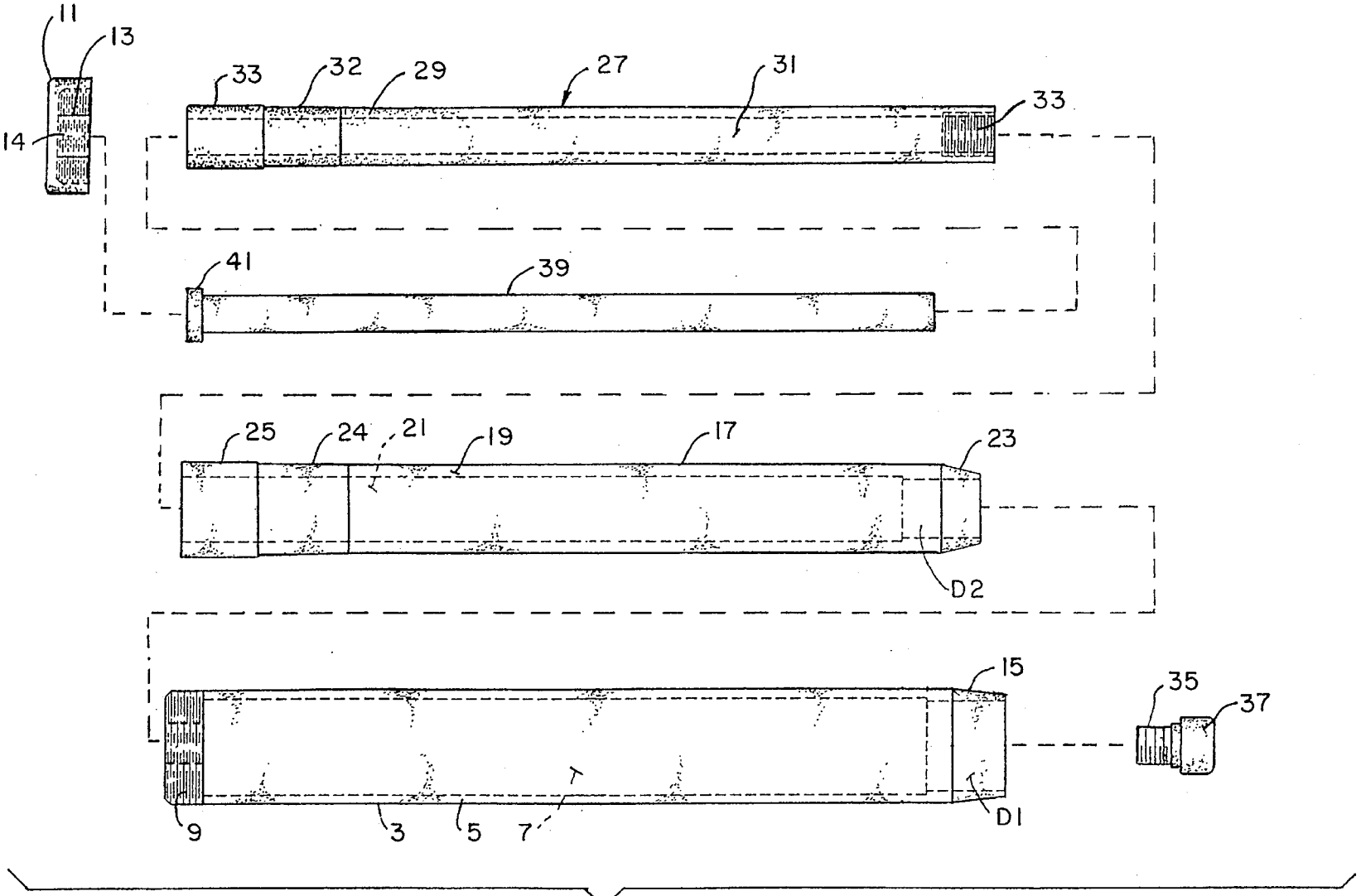
FIG. 4 is an exploded view of the telescoping baton of the present invention.

A telescoping baton of the present invention is indicated generally by reference numeral 1 in FIGS. 1–3. Baton 1 is shown in a collapsed state in FIGS. 1 and 2 and extended position in FIG. 3.

Baton 1 is comprised of a handle section 3 which is formed of a cylindrical wall 5 defining an internal bore 7. Handle section 3 can be formed from an appropriate composite material such as nylon, polycarbonate, or kevlar. Bore 7 has a diameter slightly greater than the outside diameter of the second section as will be described below.

Handle section 3 has threads 9 formed externally on the aft end for the threaded engagement of end cap 11. End cap 11 has internal threads 13 to engage threads 9. A cylindrical magnet 14 is positioned centrally in cap 11 to releasably secure the baton in a collapsed state as will be explained below. The forward end of handle 3 has a beveled head 15. Bore 7 is swaged down to reduce the diameter D within head 15.

A second section 17 is formed from cylindrical wall 19 which defines an inner bore 21. Wall 19 has an outside diameter slightly less than diameter of bore 7 in handle 3 so that section 17 can fit within bore 7. Section 17 is formed from any appropriate composite material such as nylon, polycarbonate or kevlar. Forward end of section 17 has a bevelled head 23. Bore 21 is swaged down to reduce the diameter D2 at a point corresponding internally to bevel head 23.

The aft section has an external collars 24 and 25. The outside diameter of collar 25 is essentially the same as diameter D in the forward end of bore 7 of handle section 3. 87 end section 27 is formed from cylindrical wall 29 which defines bore 31. Forward end of bore 31 has internal threads 33 to engage the threaded portion 35 of end plug 37. The aft end of section 27 has an external collar 32 and 33 formed thereon. Collar 33 has essentially the same outside diameter as the diameter D2 of the swaged end of bore 21 of middle section 17.

An elongated iron rod 39 with an outside diameter slightly less than diameter of bore 31, is inserted into bore 31. Rod 39 has a circular end piece 41 integrally formed from iron. The diameter of end piece 41 is greater than the diameter of bore 31 so that the body of rod 39 fits within bore 31 while end piece 41 of abuts collar 33.

In use, the arrangement of the elements are as indicated in FIGS. 2 and 3. Second section 17 fits within bore 7 of handle piece 3. End section 27 fits within bore 21 of second section 17. When collapsed the end piece 41 of the iron rod 39 abuts the magnet 14 in end cap 11. This magnetic attraction releasably holds the baton in a collapsed state. A sharp swing of the handle in arc causes the metal rod to exert force so that the inner telescoping sections thrust outward under centrifugal force. Collar 33 on end piece 27 engages the swaged section at diameter D2 of internal bore 21 of the second section thereby releasably locking it in place. Correspondingly, collar section 25 of second section 17 engages the diameter D1 at the swaged end of internal bore 7 of handle 3 also locking it in place. This arrangement is best illustrated in FIG. 3.

To retract the various elements of the baton, the user strikes the metallic end piece 37 against the floor or wall driving the collar sections 33 and 25 away from the swaged diameters D2 and D1 respectively thus allowing the telescoping sections to collapse within each other. Magnet 14 engages, section 41 of iron rod 39 as previously described.

Figure 5:
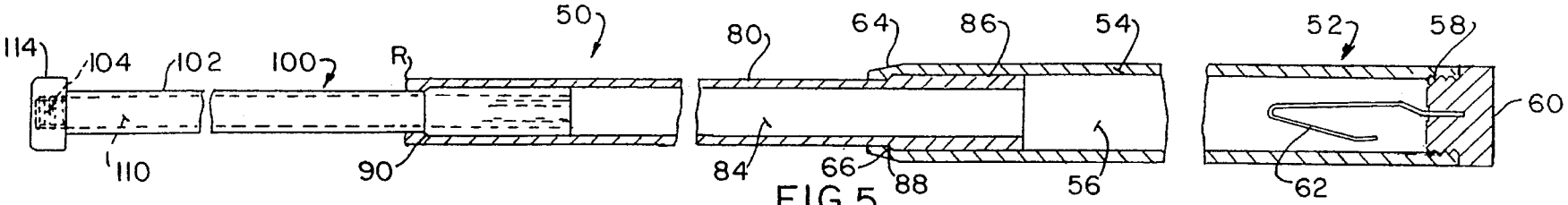
FIG. 5 is a cross-sectional view of another embodiment of the composite telescoping baton of the present invention.

A composite, telescoping baton constructed by a continuous filament winding process as indicated generally by reference numeral 50 in FIG. 5. Baton 50 is comprised of a handle section 52 formed from a cylindrical wall 54 defining an internal bore 56. Handle 52 is shown in greater detail in FIG. 7. Bore 56 has an internal diameter D3 slightly greater than the outer diameter of the second section as will be described below. Handle 52 has threads 58 formed internally in the aft end of bore 56 for the threaded engagement of end cap 60. End cap 60, which is shown in greater detail in FIG. 13, has a small piano wire spring clip 62 staked in the inside center to mate with an internal tapped hole in the baton end section as will be described hereinafter. Threaded portions 63 of the cap mates with the internally threaded segment 58 of the handle segment.

The forward end of handle 52 has an external beveled head 64. Bore 56 has a internal, circumferential bevel 66 which reduces the internal diameter D4. The face of bevel 66 is angled at an angle of approximately 8°.

Figure 6:
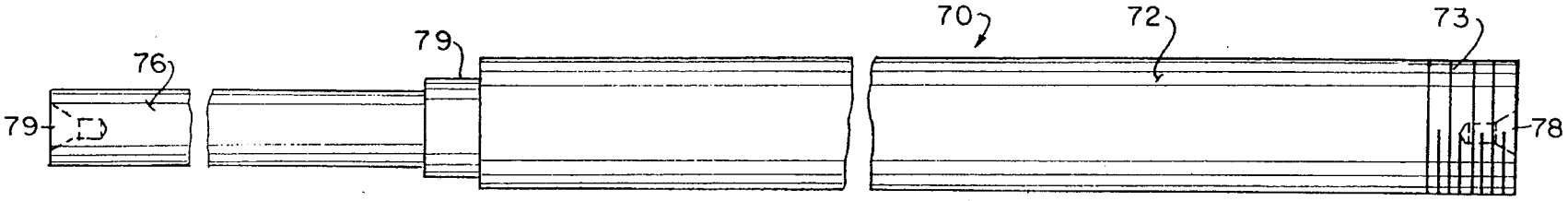
FIG. 6 is an enlarged side elevational view of a mandrel used to form the handle section of the composite telescoping baton shown in FIG. 5.

FIG. 6 is a side elevational view of the mandrel 70 used to form handle 52. Mandrel 70 is a conventional mandrel having an elongated body section 72, external threads 73 at the aft end, a bevel shoulder 74 and a spacer segment 76. A pair of opposed counterbores 78 and 79 formed in the ends of the mandrel allow for the capture of mandrel 70 in the holding and turning jaws on a the lathe-like element of a conventional filament winding machine (not shown).

Fibers of glass, for example nominally 675 yield glass continuous roving fibers such as Certainteed 660 Silane-Treated strands and Kevlar® (I. E. du Pont, de Nemours & Co., Wilmington, Del.) are fed from spools behind the winding machine and through an appropriate amount of epoxy resin binder such as Shell Chemical Epon 862 which is manufactured from epichlorohydrin and Bisphenol F (BPF) and mixed with a curing agent, for example Epon agent (W) to form a thermal setting polymer. The respective fibers strands are combined and fed through a metal feed eye on the winder traversing and wound in a helical or circumferential manner on the mandrel to form wall 54, with appropriate hoop wound strands at the joint areas, as will be described hereinafter.

Mandrel body section 72 allows for the formation of cylindrical wall 54 with bore 56 therein, the external thread 75 creating internal threads 58 and bevel shoulder 74 forming internal circumferential bevel 66.

Figure 7:
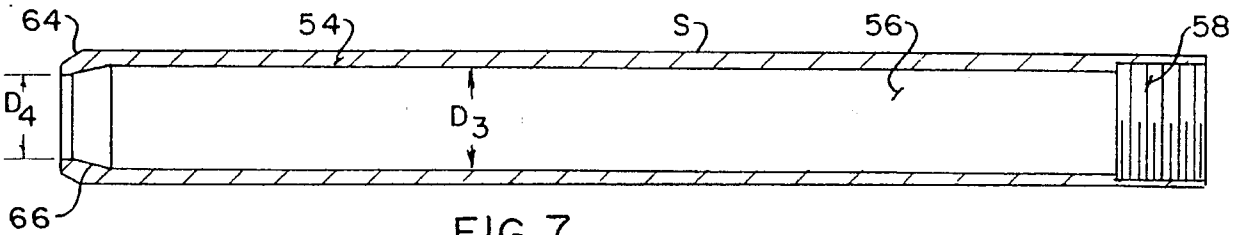
FIG. 7 is a cross-sectional view of the middle section of the composite telescoping baton of FIG. 6.

When the combination of fibers is formed in layers resulting in the proper thickness of wall 54 and bevel 66, the complete assembly of mandrel 70, with handle 52 thereon, is transferred to a curing oven and cured for three (3) hours at approximately 350°. The unfinished handle 52 is extracted from mandrel 70 which is returned to the winder for use. Handle 52, which is basically a tube at this point, is cut to the proper length and the outer surface S and internal bevel 66 are ground to the finished configuration as shown in FIG. 7.

Baton 50 has a second or middle section 80 which extends out of or collapses into bore 56 of handle 52. Middle section 80 is shown in greater detail in FIGS. 10*a* and 10*b*. Middle section 80 is formed from the cylindrical wall 82 defining bore 84 with internal diameter D5 and has an elongated forward section 85 with an external diameter D6 and an aft section 86 with an external diameter of D7 which is slightly less than the internal diameter D3 of bore 56 of handle 52. Aft section 86 is defined by positive stop shoulder 88 shown in greater detail in FIG. 10*b*. Shoulder 88 and aft section 86 have external diameter of D7 which is greater than internal diameter D4 of bevel 66 handle 50. A ramp 89 or taper of approximately 8° is formed between forward section 85 and shoulder 88. This creates a positive stop and locking arrangement between middle section 80 and handle section 50 when the baton is in a fully extended position, as illustrated in FIG. 5. An internal circumferential bevel 90 is formed in the end of forward section 85. Bevel 90 creates a section of reduced inner diameter D8 to function as a positive stop for the end section as will be explained below. Also, since the face of bevel 66° is angled 8° and ramp 89 is angled 8°, the respective bevel and face engage in a tight friction fit when the baton is extended.

Middle section 80 is formed on a mandrel similar to the mandrel 70 shown in FIG. 6. However, the middle section mandrel does not have external threads on the aft end. The glass and Kevlar® fibers are wound through epoxy and cured in the same manner as previously explained with reference to the handle section. The outer surface S2 is appropriately ground to create shoulder 88, ramp 89, and radius R on the forward end of the middle section. Internal bevel 90 is also appropriately ground and finished.

An end section 100 is seated in bore 84 of middle section 80. End section 100 is shown in greater detail in FIGS. 9*a* and 9*b*. End section 100 has an elongated forward portion 102, with a concentric, external metal threaded portion 104 extending therefrom. End section 100 has and aft portion 106 which is defined by shoulder 108. A ramp 109 or taper of approximately 8° extends from forward portion 102 to shoulder 108. Forward portion 102 has an external diameter D9 which is less than the external diameter D10 of aft section 106. Diameter D10 is slightly less than the internal diameter D5 of bore 84 to allow end 100 to seat in bore 84. However, D10 is greater than D8 to create a positive stop relationship. Since bevel 90 is angled at 8° and ramp 109 is tapered 8°, bevel 90 and ramp 109 engage in a tight friction fit when the baton is extended.

Figure 8:
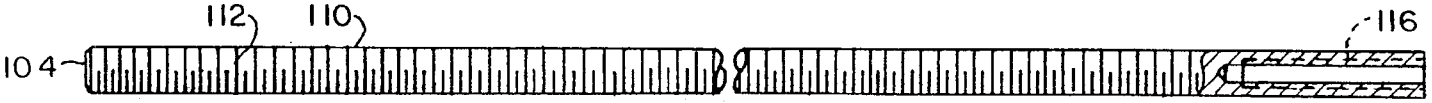
FIG. 8 is an enlarged side elevational view of the mandrel core used to form the end section thereof.
Figures 9A, 9B, 10A, 10B, 11, 12, 13:
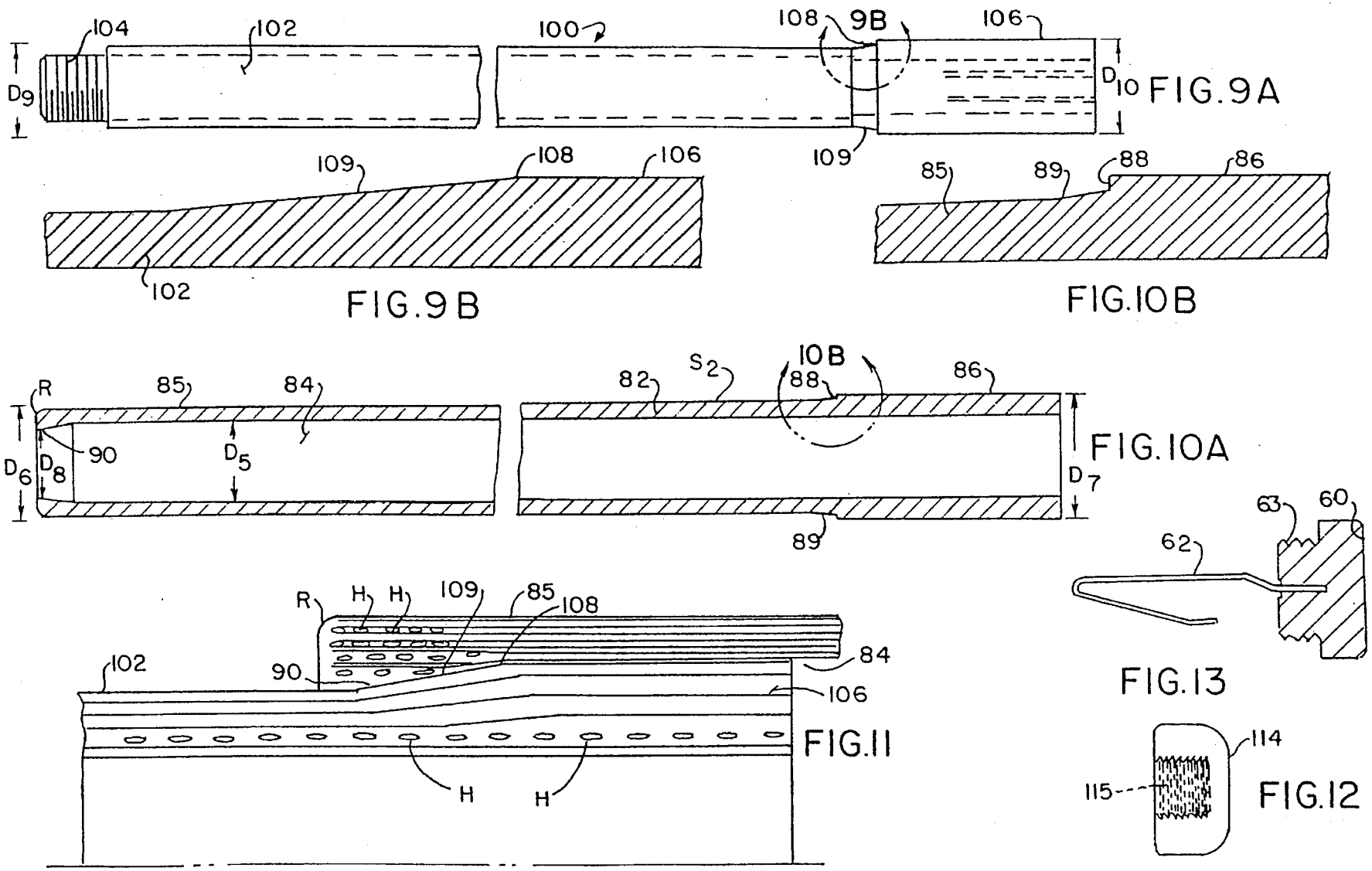
FIG. 9A is a side elevational view of the end section of the composite telescoping baton of FIG. 5.
FIG. 9B is a partial section of the baton shown in FIG. 9A.
FIG. 10A is a partial cross-sectional view of the middle section of the composite telescope shown in FIG. 5.
FIG. 10B is a partial section of the locking joint area of the middle section.
FIG. 11 is a partial cross-sectional view of a locking joint.
FIG. 12 is a side elevational view of the end section.
FIG. 13 is a cross-sectional view of the handle end.

End 100 is formed from the continuous winding process similar to that as previously described in reference to the middle end handle sections, with one notable difference. An elongated steel core 110, shown in greater detail in FIG. 8, is used as the mandrel and is permanently retained within end section 100. Core 110 is machined from a harden, high strength steel or other appropriate material that provides maximum flexure without deformation. Core 110 has external threads 112 its entire length that protrude beyond the fiber winding to form threaded portion 104. Threads 112 provide added contact and holding for the fibers which are overwound and cured on core 110. As stated above, threaded end 104 extends beyond the winding to accommodate a tip 114. Tip 114, as shown in FIG. 12, is formed either by machining or injection molding of a high impact thermal plastic composite. Internal threads 115 are either formed or tapped to mate with threaded end 104. Tip 112 provides an end cover and prevents exposure of metal core 110. The threads are formed with a mismatch of 23 to 24 threads per inch between threads 115 and 104 to provide an interference fit so that the threads engage with added force and the tip does not come off during use. Core 110 is tapped, as at 116 to provide a bore for the engagement of clip 62 when the baton is collapsed so as to hold the baton in a collapsed state.

FIG. 11 best illustrates the fiber orientation and fiber layers in the tapered joint areas between end 100 and middle section 80. It should be noted that the joint areas between middle section 80 and handle 50 are wound in a similar manner. Each hollow tube (i.e. 50 and 80) is first wound at a low angle using both Kevlar® and glass fibers to provide tensile strength and resistance to bending. High fibers angle orientations or hoops H of fibers, provide hoop strength for the cylindrical walls. For example at the joints, the hoops H restrict perpendicular forces which tend to cause the wall to expand at bevel 90 thereby increasing D8 greater than D10 allowing end section 100 to come out of bore 84. Likewise, the hoop orientation of fiber to create hoops H at the joint between the middle section and handle section resist expansion of cylindrical wall 54 at bevel 66 which can cause an increase in D4 to greater than D7 thus allowing middle section 50 to come out of bore 56 in handle 50. Hoops H also provide memory. When ramp 109 forces bevel 90 to slightly expand hoops H retain a close diameter tolerance and grasp ramp 109, as well as aft end 106, to provide positive lock in the extended, usable position.

To collapse the baton the user can sharply strike tip 114 against a hard object forcing the respective ramps and shoulders away from the respective bevels allowing the sections to collapse into each other. Clip 62 engages bore 116 with a friction fit to hold the baton in the collapsed state.

It will be obvious to those skilled in the art that various changes or modification can be made in the expandable baton of the present invention without departing from the scope of the appended claims. Therefore, the preceding description and accompanying drawings are intended to be illustrative only and should not be construed in a limiting sense.

What is claimed:

1. A telescoping baton for use in self defense or training, comprising:

a cylindrical handle section having an axial bore formed therein, said handle section formed from and having a continuous winding of filaments of wound fibers formed in layers in an epoxy material;

a cylindrical second section disposed within said axial bore in said handle section and being capable of being extended out of said handle section or retracted into said handle section, said second section having an axial bore formed therein, said second section being formed of continuously wound filaments of wound fibers formed in layers in an epoxy material;

an end section, a metal core provided within said end section, said end section disposed within said second section and being capable of being extended out of said second section and retracted into said second section, said end section being formed of continuous wound filaments of wound fibers formed in layers in epoxy material around said metal core; and means for second section and said end section in an extended position.

2. The invention of claim 1 wherein said continuously wound fibers are comprised of both glass and Kevlar® fiber.

3. The invention of claim 1 wherein said handle has a end cap, said end cap having a wire clip extending axially therefrom to engage a bore in said end section to provide a holding means to hold said baton in a retracted position.

4. The invention of claim 3 wherein said end cap is removable to allow assembly of said sections.

5. A method of making a telescoping baton comprised the steps of:

placing a handle section mandrel in a filament winding machine;

rotating said mandrel;

applying filaments of fibers to said mandrel for winding thereon;

applying epoxy to said filaments to form a composite of filaments in epoxy;

removing said mandrel and composite from said filament winding machine;

curing said composite;

removing said composite from said mandrel;

grinding said composite into a desired external shape;

placing a middle section mandrel in a continuous winding filament machine;

rotating said mandrel;

applying filaments of fibers to said mandrel for winding thereon;

applying epoxy to said filament on said mandrel to form a composite middle section of filaments in epoxy;

removing said mandrel and composite from said winding machine;

curing said composite;

placing an end section metal mandrel in said continuous filament winding machine;

rotating said metal mandrel;

applying filaments of fibers to said metal mandrel for winding thereon;

applying epoxy to said filaments to form a filament and epoxy composite around said metal mandrel;

curing said composite upon the mandrel;

assembling said handle and middle section and said end section into an expandable baton, and applying an end cap to said end section to provide a holding means to hold said baton in its retracted position.

* * * * *

UNITED STATES PATENT AND TRADEMARK OFFICE

CERTIFICATE OF CORRECTION

PATENT NO. : 5,568,922

DATED : October 29, 1996

INVENTOR(S) : Bruce K. Siddle

It is certified that error appears in the above-indentified patent and that said Letters Patent is hereby corrected as shown below:

Column 6, Claim 1, line 45, after "for" and before "second", insert ---locking said---.

Signed and Sealed this

Twenty-fifth Day of March, 1997

*Attest:*

*Attesting Officer*

BRUCE LEHMAN

*Commissioner of Patents and Trademarks*